US006830055B1

(12) United States Patent
Frame et al.

(10) Patent No.: US 6,830,055 B1
(45) Date of Patent: Dec. 14, 2004

(54) HAIR ORNAMENT RETAINING IMPLEMENTS

(76) Inventors: Bridget R. Frame, 1920 Parkview, Rock Springs, WY (US) 82901; Stanley D. Goodman, 691 Birchwood Dr., Wyckoff, NJ (US) 07481

( * ) Notice: Subject to any disclaimer, the term of this patent is extended or adjusted under 35 U.S.C. 154(b) by 0 days.

(21) Appl. No.: 10/320,088

(22) Filed: Dec. 16, 2002

Related U.S. Application Data

(63) Continuation-in-part of application No. 09/993,047, filed on Nov. 6, 2001, now Pat. No. 6,523,549.

(51) Int. Cl.[7] ..... A45D 8/12
(52) U.S. Cl. ..... 132/275
(58) Field of Search ..... 132/273, 275, 132/280, 283, 284, 200; 24/16 R, 30.5 S, 30.5 T; D28/39, 40, 41, 42, 43, 75; 63/38, 39

(56) References Cited

U.S. PATENT DOCUMENTS

| | | | | |
|---|---|---|---|---|
| D50,981 | S | 7/1917 | Creech et al. | |
| D52,947 | S | 2/1919 | Creech et al. | |
| 1,618,385 | A | 2/1927 | Pearson | |
| 3,535,746 | A * | 10/1970 | Thomas, Jr. | 24/30.5 P |
| 3,536,746 | A | 10/1970 | Thomas, Jr. | |
| 3,543,353 | A * | 12/1970 | Meehan | 24/16 PB |
| 3,587,595 | A | 6/1971 | Popeil | |
| 4,079,484 | A * | 3/1978 | Nakama | 24/16 PB |
| 4,484,378 | A * | 11/1984 | Kimura et al. | 24/30.5 S |
| 4,489,111 | A * | 12/1984 | Woodrum | 428/11 |
| D280,180 | S * | 8/1985 | Burt | D8/394 |
| 5,115,825 | A * | 5/1992 | Kuhn | 132/273 |
| D347,493 | S | 5/1994 | Connolly | |
| 5,318,054 | A | 6/1994 | Neilson et al. | |
| D364,482 | S | 11/1995 | Hsu | |
| D368,150 | S | 3/1996 | Pereira | |
| 5,566,690 | A | 10/1996 | Shih-Ming | |
| 5,797,408 | A * | 8/1998 | Wilson | 132/275 |
| 6,601,965 | B2 * | 8/2003 | Kamara | 362/104 |

* cited by examiner

*Primary Examiner*—Todd E. Manahan
(74) *Attorney, Agent, or Firm*—Arthur Jacob

(57) ABSTRACT

A hair ornament retaining implement includes a band of resiliently deflectable material having a normally open loop for receiving multiple strands of hair of an individual, and integral legs for being selectively intertwined to close the loop and cinch the multiple strands of hair so as to secure the implement to the hair. Knobs placed at the ends the legs secure the loop closed and are constructed of a light-transmitting material, the knobs including holes filled with a filler material of a color contrasting with the visual appearance of the legs so as to visually imbue the knobs with a color contrasting with the visual appearance of the legs and provide the implement with an aesthetically appealing decorative effect for decorating the hair when the implement is secured to the hair.

7 Claims, 7 Drawing Sheets

HAIR ORNAMENT RETAINING IMPLEMENTS

This is a continuation-in-part of application Ser. No. 09/993,047, filed Nov. 6, 2001, now U.S. Pat. No. 6,523,549 for HAIR ORNAMENT RETAINING IMPLEMENTS AND METHOD.

The present invention relates generally to decorating an individual's hair and pertains, more specifically, to implements for retaining ornamental items on the head of a person through ready and convenient attachment to the person's hair.

Throughout time immemorial, people have employed a very wide variety of ornamental devices to decorate themselves and, in particular, to enhance the appearance of the hair on their heads. Women, especially, have sought new and unique ornamental arrangements for accentuating the beauty of their hair in efforts to increase their attractiveness.

The present invention provides hair ornament retaining implements by which a person's hair is uniquely decorated with ease and versatility. As such, the present invention attains several objects and advantages, some of which are summarized as follows: Provides exceptionally simple and highly effective implements for retaining ornaments in strands of a person's hair; allows convenient and economical decoration of a person's hair with a very wide variety of ornamental items; enables a very high degree of versatility in accomplishing a myriad of decorative effects for the hair, with minimal expense; attains new and unique aesthetic effects in the decoration of hair; offers opportunities for the exercise of increased individual creativity in accomplishing decorative innovations in connection with the ornamentation of hair; provides new approaches to hair ornamentation, engendering widespread appeal.

The above objects and advantages, as well as further objects and advantages, are attained by the present invention which may be described briefly a hair ornament retaining implement for being looped around and secured to multiple strands of hair of an individual so as to fasten an ornament to the hair to decorate the hair, the implement comprising: a band of resiliently deflectable material, the band having a loop establishing an inner eye within the loop and an entrance for admitting multiple strands of hair into the eye of the loop, and opposed legs extending longitudinally along the entrance and laterally outwardly in opposite directions so as to terminate at laterally spaced apart terminal ends, the opposed legs each having a given visual appearance; a knob at each terminal end for facilitating an intertwining of the opposed legs to close the entrance and cinch the loop around the multiple strands of hair so as to maintain the legs intertwined and secure the implement to the hair; at least one of the knobs being constructed of a light-transmitting material; and a filler material placed within the one knob, the filler material being of a color contrasting with the visual appearance of a corresponding leg for visually imbuing the one knob with a color contrasting with the visual appearance of the corresponding leg to decorate the hair upon securing the implement to the hair.

The invention will be understood more fully, while still further objects and advantages will become apparent, in the following detailed description of preferred embodiments of the invention illustrated in the accompanying drawing, in which.

Figure 1:
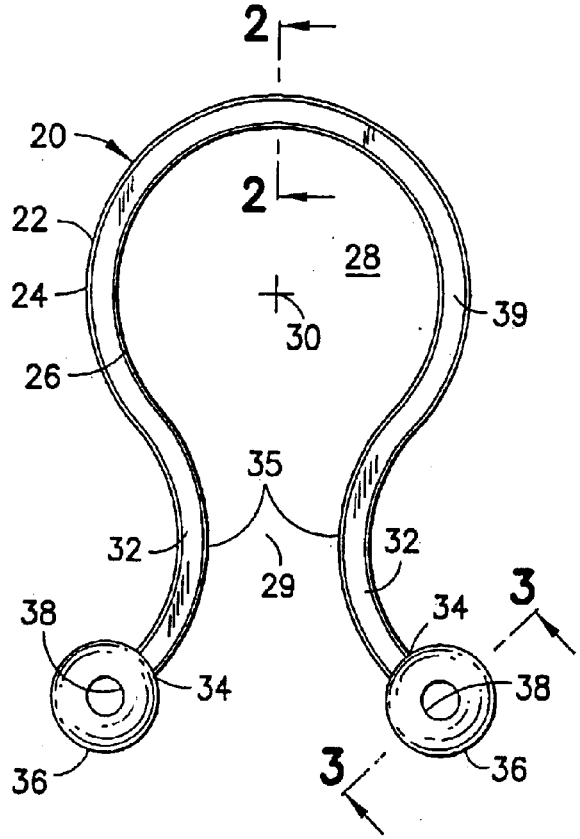
FIG. 1 is a plan view of a hair ornament retaining implement constructed in accordance with the present invention.
Figure 2:
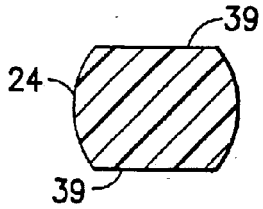
FIG. 2 is an enlarged cross-sectional view taken along line 22 of FIG. 1.
Figure 3:
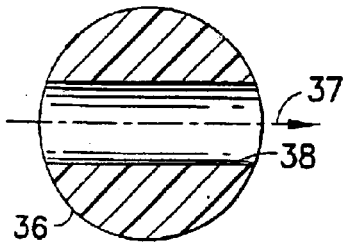
FIG. 3 is an enlarged cross-sectional view taken along line 33 of FIG. 1.

Referring now to the drawing, and especially to FIGS. 1 through 3 thereof, a hair ornament retaining implement constructed in accordance with the present invention is illustrated at 20 and is seen to have a body 22 including a band 24 of resiliently deflectable material extending in a longitudinal direction to form a loop 26 normally open to establish an inner eye 28 within the loop 26, the eye 28 having an entrance 29 and a transverse axis 30 (extending perpendicular to the plane of the paper in FIG. 1). A pair of laterally opposed legs 32 extend longitudinally from the loop 26 along the entrance 29 and terminate at laterally spaced apart terminal ends 34. The legs 32 are bowed so as to curve inwardly, toward one another, at 35 and then extend outwardly to the laterally spaced apart terminal ends 34. An enlarged knob 36 is placed at each terminal end 34 and a coupling element is located on at least one, and preferable on both knobs 36, coupling elements being illustrated in the form of an aperture 38 extending transversely into each knob 36, along a direction 37 essentially parallel to axis 30. Body 22 preferably is constructed of a synthetic polymeric material, such as polypropylene, and is advantageously molded in one piece, so that band 24, legs 32 and knobs 36 all are parts of a simple, economically manufactured unitary construction. In the embodiment illustrated in FIG. 1, the band 24 has a partially circular cross-sectional configuration, flattened along transversely opposite essentially flat faces 39, as seen in FIG. 2, the knobs 36 each are provided with an orbicular configuration, and each aperture 38 is in the form of a hole which extends fully through respective knob 36, as seen in FIG. 3.

Figure 4:
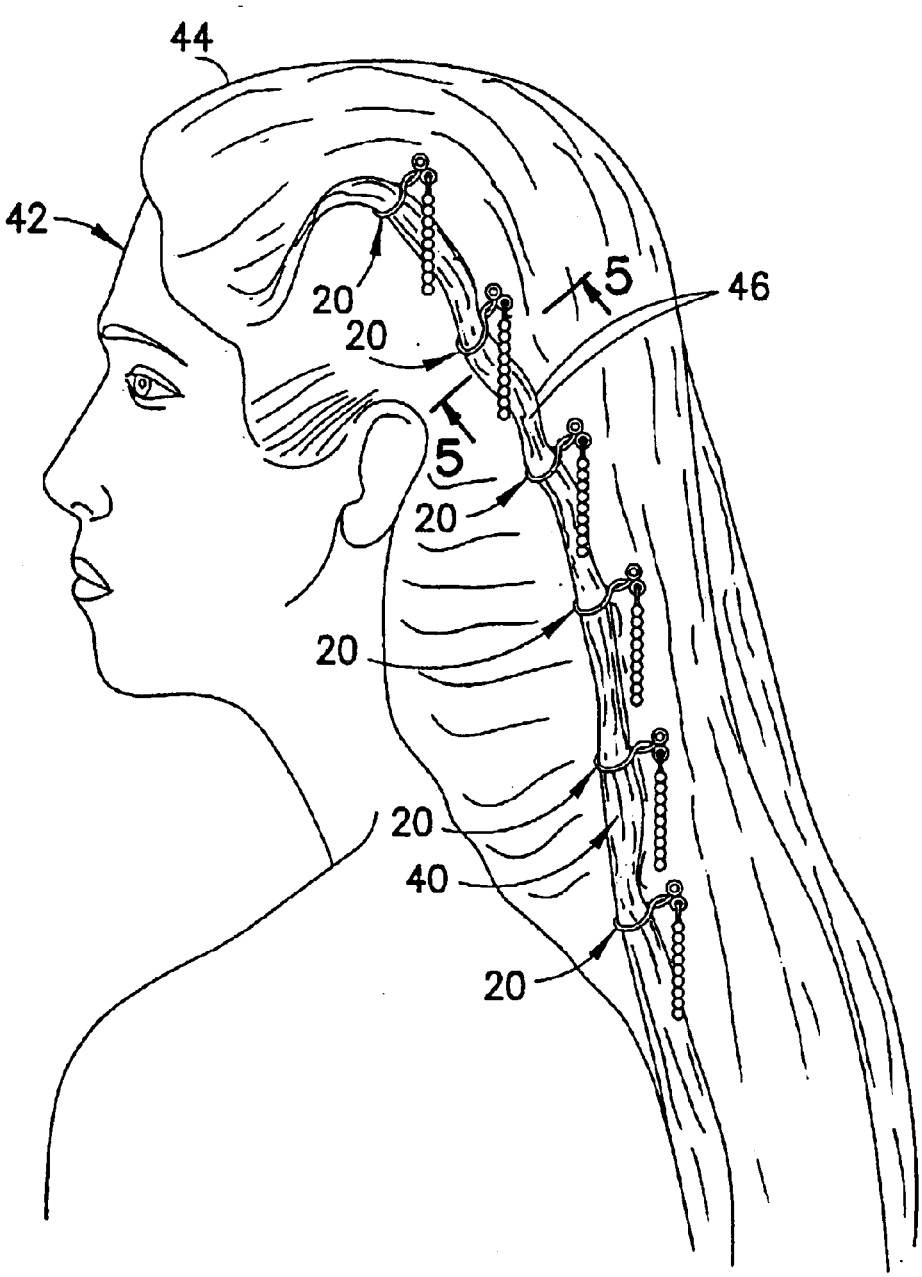
FIG. 4 is a pictorial view illustrating several hair ornament retaining implements in place in a person's hair.
Figure 5:
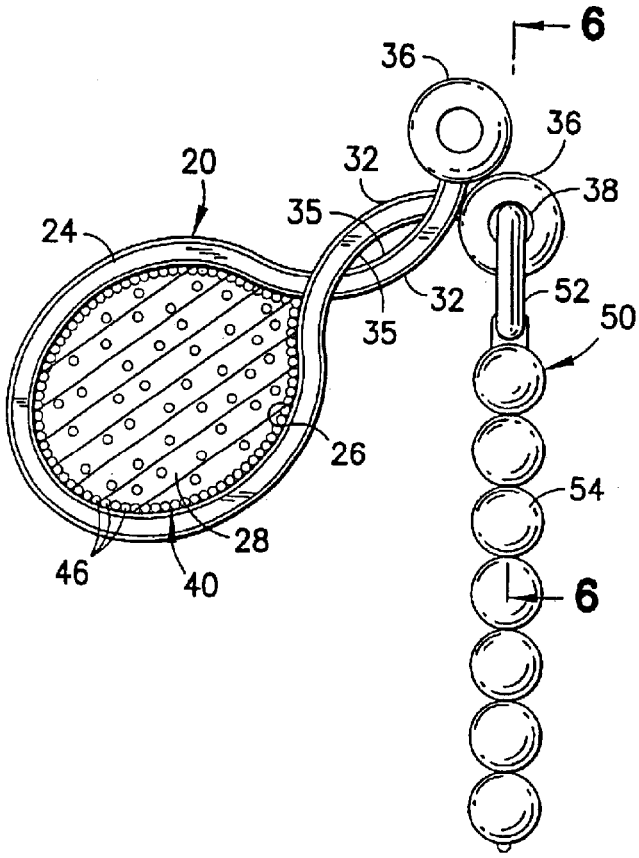
FIG. 5 is an enlarged view taken along line 5—5 of FIG. 4 and showing one of the implements of FIG. 4 secured to strands of hair at the person's head.

Turning now to FIGS. 4 and 5, implement 20 is secured to hair 40 of an individual 42, at the head 44 of the individual 42, by first admitting selected multiple strands 46 of hair 40 between the legs 32 of the implement 20, through the entrance 29, and into the eye 28 of the loop 26. Then, the legs 32 are intertwined, as seen in FIG. 5, to close the entrance 29 and loop 26, and cinch the band 24 around the multiple strands 46 of hair 40 so as to secure the implement 20 in place in the hair 40, the intertwining of the legs 32 being facilitated by the flattened partially circular cross-sectional configuration provided by transversely opposite essentially flat faces 39. The knobs 36 assist in enabling manipulation of the legs 32 into the intertwined position, and then act detent-like in concert with the bowed portions 35 of the legs 32 to maintain the closed cinch of the band 24 so that the implement 20 remains secured in place until selectively released by reversal of the above procedure to disengage the intertwined legs 32 from one another and open entrance 29.

Figure 6:
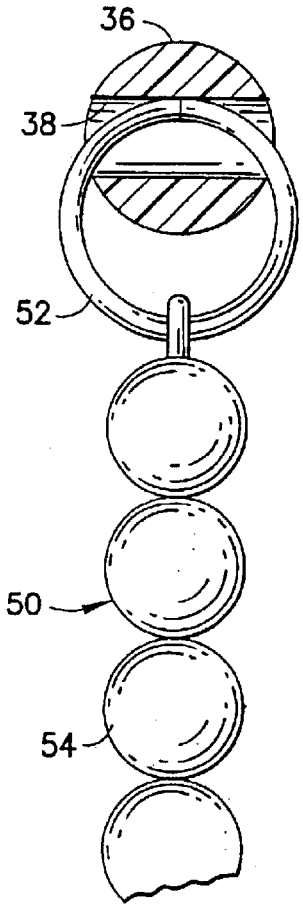
FIG. 6 is an enlarged fragmentary cross-sectional view taken along line 6—6 of FIG. 5.

A hair ornament is shown in the form of a bangle 50 which includes a ring 52 and a decorative beaded chain 54. As best seen in FIG. 6, the ring 52 carries the chain 54 and is engaged with aperture 38 in the knob by being threaded through the aperture 38 to couple the chain 54 to the knob 36 and, thus, to the implement 20. In this manner, the bangle 50 is retained simply and conveniently in any selected location along the hair 40.

Figure 7:
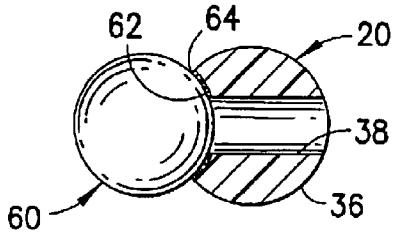
FIG. 7 is an enlarged fragmentary cross-sectional view similar to FIG. 6, but showing another alternate hair ornament.

As seen in FIG. 7, an alternate hair ornament in the form of a bead 60 is retained in the individual's hair by implement 20. In this embodiment, aperture 38 includes a seat 62 for the reception and engagement of bead 60 and coupling of bead 60 to knob 36 and, thus, to implement 20. In this instance, an adhesive 64 affixes the bead 60 within the seat 62.

Figure 8:
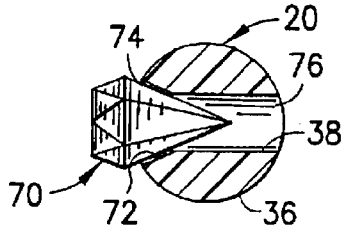
FIG. 8 is an enlarged fragmentary cross-sectional view similar to FIG. 6, but showing still another alternate hair ornament.

Another alternate hair ornament is shown in FIG. 8 in the form of a gemstone 70 seated within a seat 72 provided by aperture 38. Again, an adhesive 74 is employed to assure affixation of the gemstone 70 coupled with the knob 36; however, aperture 38 provides air space 76 behind the gemstone 70 to enable the desired refraction and total reflection of light within the gemstone 70.

Figure 9A:
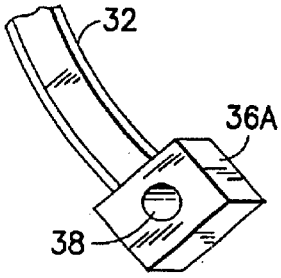
FIGS. 9A through 9E are fragmentary pictorial views illustrating alternate configurations of portions of the hair ornament retaining implement.
Figure 9B:
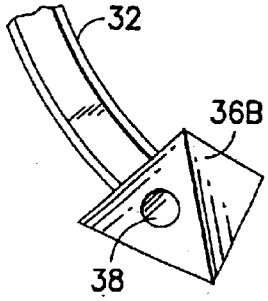
Figure 9C:
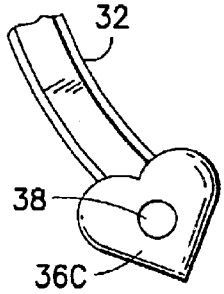
Figure 9D:
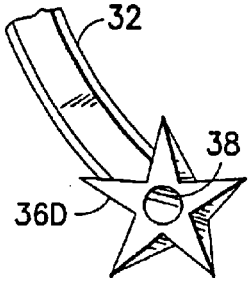
Figure 9E:
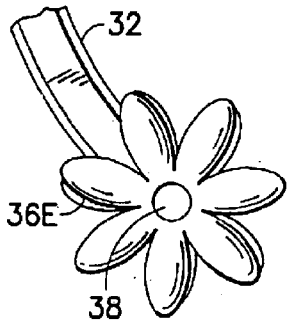

As another decorative alternative, knob 36 itself may be provided with any one of numerous ornamental configurations. As illustrated in FIGS. 9A through 9E, knob 36A in FIG. 9A has a cubic configuration, while in FIG. 9B knob 36B is provided with a pyramidal configuration. Knob 36C is seen in FIG. 9C to have a cardioid configuration, knob 36D is illustrated in FIG. 9D with a star-shaped configuration, and knob 36E is depicted in FIG. 9E with a floral configuration. It will be apparent that a variety of ornamental configurations can be formed integral with implement 20 by varying the configurations of knobs 36.

Figure 10:
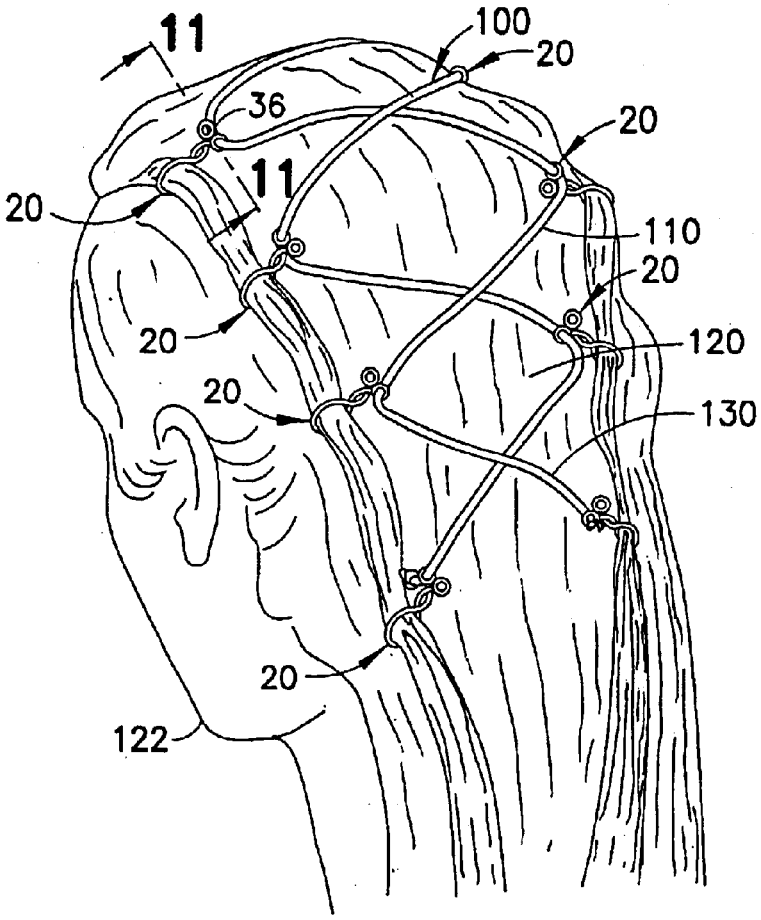
FIG. 10 is a pictorial view illustrating a decorative hair appliance constructed in accordance with the present invention in place in a persons's hair.
Figure 11:
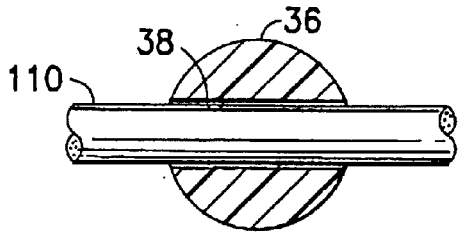
FIG. 11 is an enlarged fragmentary cross-sectional view taken along line 11—11 of FIG. 10.

Referring now to FIGS. 10 and 11, a hair appliance 100 utilizes a plurality of implements 20 to provide another decorative alternative. Thus, a decorative cord 110 is threaded through at least one aperture 38 of each one of the plurality of implements 20, as seen in FIG. 11, and the assembled implements 20 and cord 110 are arranged throughout hair 120 of individual 122, as illustrated in FIG. 10, so as to provide an integrated hair ornament 130 secured to the hair 120 of individual 122. In the preferred arrangement, decorative cord 110 is constructed of an elastic material so as to better follow any one of a myriad of aesthetic patterns established by selecting particular locations for the securement of implements 20 to hair 120 and routing the cord 110 to extend between the secured implements 20. In addition, cord 110 serves to hold hair 120 in place in selected hair arrangements, and that holding function is enhanced by the resilient expansion and contraction provided by an elastic cord 110.

Figure 12:
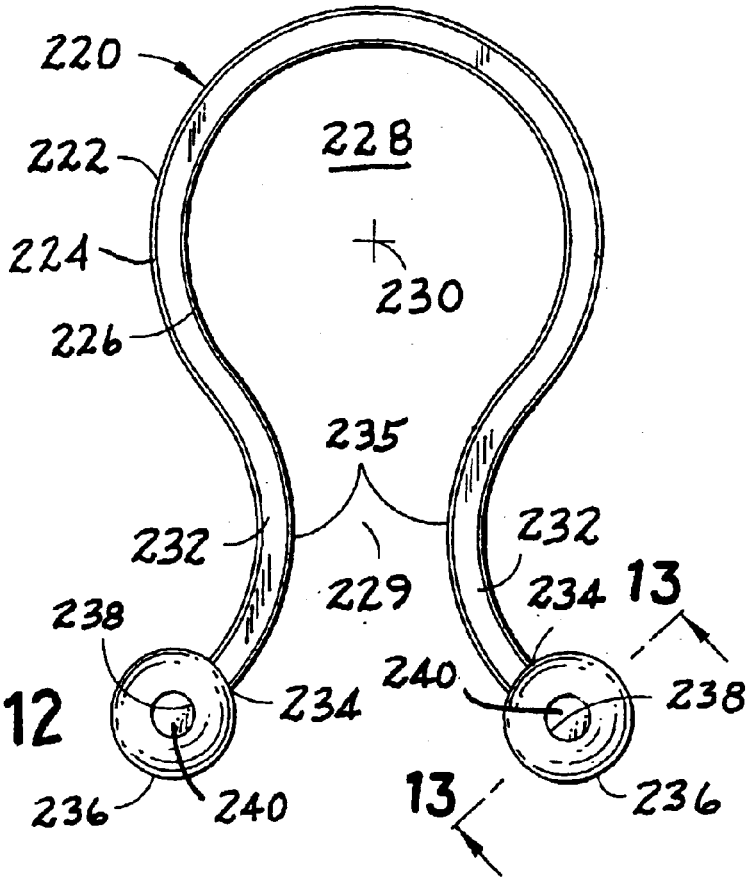
FIG. 12 is a plan view of another hair ornament retaining implement constructed in accordance with the present invention.
Figure 13:
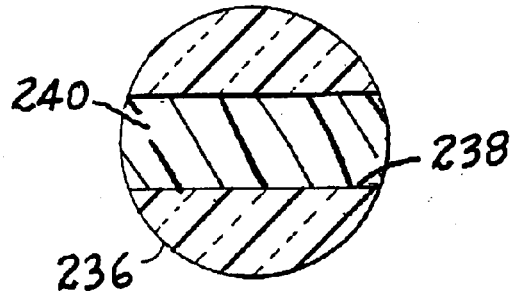
FIG. 13 is an enlarged cross-sectional view taken along line 13—13 of FIG. 12.

The embodiment of the invention illustrated in FIGS. 12 and 13 is similar to that of FIGS. 1 through 3 in that hair ornament retaining implement 220 is seen to have a body 222 including a band 224 of resiliently deflectable material extending in a longitudinal direction to form a loop 226 normally open to establish an inner eye 228 within the loop 226, the eye 228 having an entrance 229 and a transverse axis 230 (extending perpendicular to the plane of the paper in FIG. 12). A pair of laterally opposed legs 232 extend longitudinally from the loop 226 along the entrance 229 and terminate at laterally spaced apart terminal ends 234. The legs 232 are bowed so as to curve inwardly, toward one another, at 235 and then extend outwardly to the laterally spaced apart terminal ends 234. An enlarged knob 236 is placed at each terminal end 234 and an opening is placed in at least one, and preferable in both knobs 236, the openings each being illustrated in the form of a hole 238 extending transversely into each knob 236. In the embodiment of FIG. 12, knobs 236 each are provided with an orbicular configuration, and each opening is in the form of a hole 238 which extends fully through respective knob 236, as seen in FIG. 13.

A unique ornamental aesthetic effect is accomplished by constructing at least the knobs 236 of a light-transmitting material, and placing a material of contrasting color within the hole 238 of each of the knobs 236. The visual effect, then, imbues the knobs 236 with a color which contrasts with the visual appearance of the legs 232 and establishes an aesthetically appealing effect. In the illustrated embodiment of FIG. 12, the entire body 222 preferably is constructed of a transparent or translucent synthetic polymeric material, such as nylon or polypropylene, and is advantageously molded in one piece, so that band 224, legs 232 and knobs 236 all are parts of a simple, economically manufactured unitary construction. Each hole 238 preferably extends fully through corresponding knob 236 and is filled entirely with a filler material 240 of contrasting color, such as an epoxy filler or an insert of solid material, which is secured within each hole 238 and which then serves to visually imbue each corresponding knob 236 with a color corresponding to the color of the filler material 240 and contrasting with the visual appearance of each corresponding leg 232.

Figure 14A:
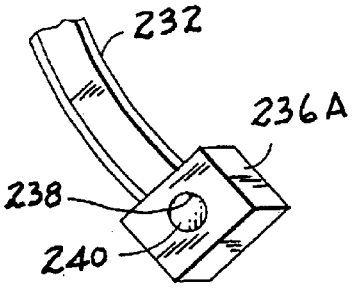
FIGS. 14A through 14E are fragmentary pictorial views illustrating alternate configurations of portions of the hair ornament retaining implement of FIG. 12.
Figure 14B:
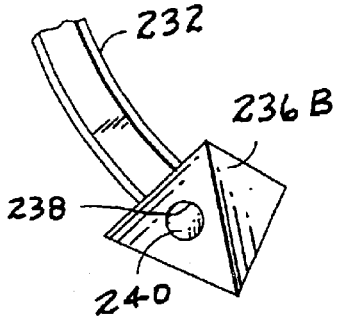
Figure 14C:
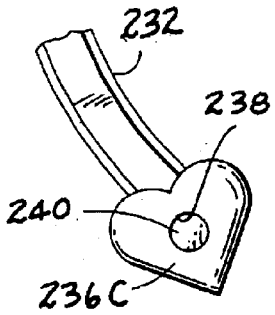
Figure 14D:
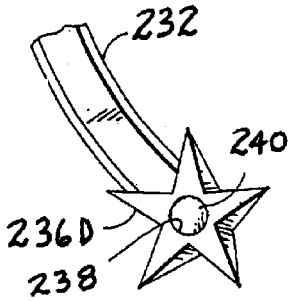
Figure 14E:
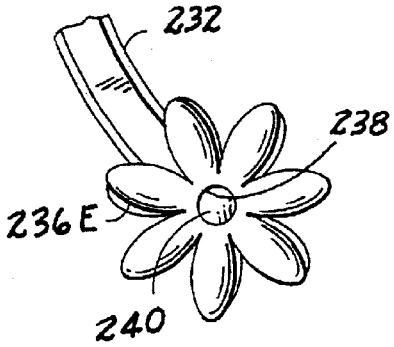

Turning now to FIGS. 14A through 14E, as another decorative alternative, knob 236 itself may be provided with any one of numerous ornamental configurations. Thus, in FIG. 14A knob 236A has a cubic configuration, while in FIG. 14B knob 236B is provided with a pyramidal configuration. Knob 236C is seen in FIG. 14C to have a cardioid configuration, knob 236D is illustrated in FIG. 14D with a star-shaped configuration, and knob 236E is depicted in FIG. 14E with a floral configuration. It will be apparent that a variety of ornamental configurations can be formed integral with implement 220 by varying the configurations of knobs 236. Each knob 236A through 236E is constructed of a light-transmitting material and hole 238 in each knob 236A through 236E is filled with filler material 240 having a color which contrasts with the color, or other visual appearance, of corresponding leg 232, thereby visually imbuing each knob 236A through 236E with a color corresponding to the color of the filler material 240 and contrasting with the visual appearance of corresponding leg 232. The choice of the contrasting color of filler material 240 may be suggested by the particular configuration of the knob 236. For example, a red filler material 240 placed within knob 236C will provide the cardioid configuration with a red hue considered appropriate to a heart-like configuration and contrasting with a transparent or translucent adjacent leg 232; a yellow filler material 240 placed within knob 236D will provide the star-shaped configuration with a star-like yellow hue which will contrast with the visual appearance of an adjacent leg 232 of another color; and a pink filler material 240 placed within knob 236E will visually imbue the floral configuration with a delicate flower-pink tinge contrasting with the visual appearance of adjacent leg 232. In the preferred construction, each hole 238 extends fully through each knob 236, and filler material 240 fills each hole 238 entirely.

It will be seen that the present invention attains all of the objects and advantages summarized above, namely: Provides exceptionally simple and highly effective implements for retaining ornaments in strands of a person's hair; allows convenient and economical decoration of a person's hair with a very wide variety of ornamental items; enables a very high degree of versatility in accomplishing a myriad of decorative effects for the hair, with minimal expense; attains new and unique aesthetic effects in the decoration of hair; offers opportunities for the exercise of increased individual creativity in accomplishing decorative innovations in connection with the ornamentation of hair; provides new approaches to hair ornamentation, engendering widespread appeal.

It is to be understood that the above detailed description of preferred embodiments of the invention is provided by way of example only. Various details of design and construction may be varied without departing from the true spirit and scope of the invention, as set forth in the appended claims.

The embodiments of the invention in which an exclusive property or privilege is claimed are defined as follows:

1. A hair ornament retaining implement for being looped around and secured to multiple strands of hair of an individual so as to fasten an ornament to the hair to decorate the hair, the implement comprising:

a band of resiliently deflectable material, the band having a loop establishing an inner eye within the loop and an entrance for admitting multiple strands of hair into the eye of the loop, and opposed legs extending longitudinally along the entrance and laterally outwardly in opposite directions so as to terminate at laterally spaced apart terminal ends, the opposed legs each having a given visual appearance;

a knob at each terminal end for facilitating an intertwining of the opposed legs to close the entrance and cinch the loop around the multiple strands of hair so as to maintain the legs intertwined and secure the implement to the hair;

at least one of the knobs being constructed of a light-transmitting material;

a hole extending into the one knob; and a filler material placed within the one knob, secured within the hole of the one knob so as to be placed within the one knob, the filler material being of a color contrasting with the visual appearance of a corresponding leg to comprise means for visually imbuing the one knob with a color contrasting with the visual appearance of the corresponding leg to decorate the hair upon securing the implement to the hair.

2. The implement of claim 1 wherein the hole extends fully through the one knob and the filler material fills the hole entirely.

3. The implement of claim 1 wherein each knob is constructed of a light-transmitting material, the implement includes a hole extending into each knob and filler material is secured within each hole.

4. The implement of claim 3 wherein each hole extends fully through a corresponding knob and filler material fills each hole entirely.

5. The implement of claim 1 wherein each knob has a decorative shaped configuration and the filler material in each know visually imbues the knob with a color suggested by the shaped configuration.

6. The implement of claim 5, wherein the decorative shape configuration is orbicular.

7. The implement of claim 5 wherein the decorative shaped configuration is selected from the group of decorative shaped configurations consisting of cubic, pyramidal, cardioid, star-shaped and floral.

* * * * *